United States Patent [19]

Shank

[11] Patent Number: 4,738,002

[45] Date of Patent: Apr. 19, 1988

[54] HINGE MOUNTED DOORCHECK

[76] Inventor: Joseph M. Shank, 6119 Noland Rd., Shawnee, Kans. 66216

[21] Appl. No.: 931,265

[22] Filed: Nov. 17, 1986

[51] Int. Cl.[4] ..... E05F 5/00

[52] U.S. Cl. ..... 16/82; 16/223; 16/374

[58] Field of Search ..... 16/377, 374, 82, 50, 16/250, 223, 356, DIG. 17; 411/138, 140, 157, 160, 162

[56] References Cited

U.S. PATENT DOCUMENTS

| | | | |
|---|---|---|---|
| 491,645 | 2/1893 | Hart | 16/374 |
| 609,277 | 8/1898 | Isidor | 16/374 |
| 1,696,936 | 1/1929 | Breueman | 16/82 |
| 1,895,658 | 1/1933 | Geske | 16/250 |
| 2,143,275 | 1/1939 | Licteig | 16/374 |
| 2,280,655 | 4/1942 | Madsen | 16/374 |
| 2,592,230 | 4/1952 | Allen | 16/223 |
| 3,971,099 | 7/1976 | Wallace | 16/50 |

FOREIGN PATENT DOCUMENTS

| | | | |
|---|---|---|---|
| 942729 | 2/1949 | France | 16/377 |

*Primary Examiner*—Nicholas P. Godici
*Assistant Examiner*—Gerard M. Reid

[57] ABSTRACT

Hinge mounted doorstops which include channel members having a normally horizontal perforated web and normally vertical opposed flanges on opposite sides of the web mountable on top of door hinge hubs, engaged by the top hinge pin, edges of the flanges engaging the hinge leaves to limit door opening past a predetermined arcuate amount. The hinge mounted doorstops permitting opening of doors in the general arcuate range of 90° to 180°.

1 Claim, 3 Drawing Sheets

Fig.10.
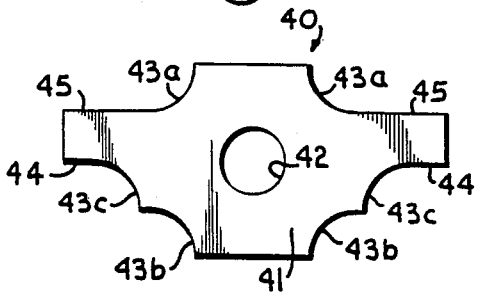
Fig.11.
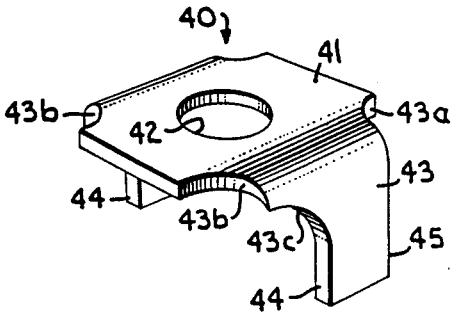
Fig.12.
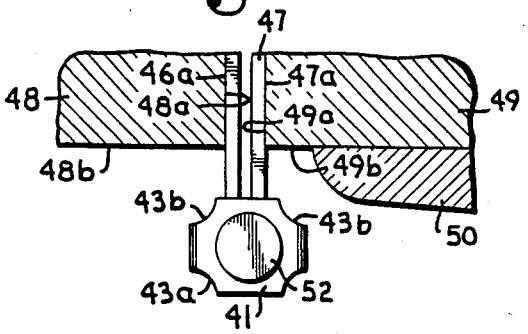
Fig.13.
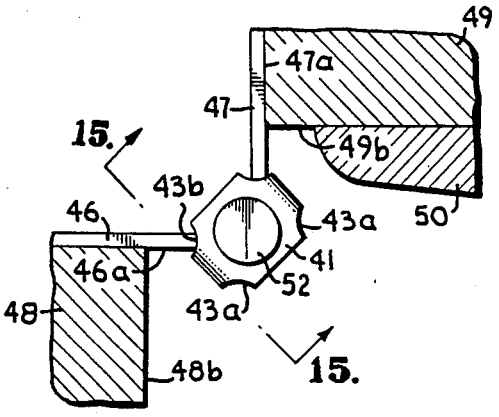
Fig.14.
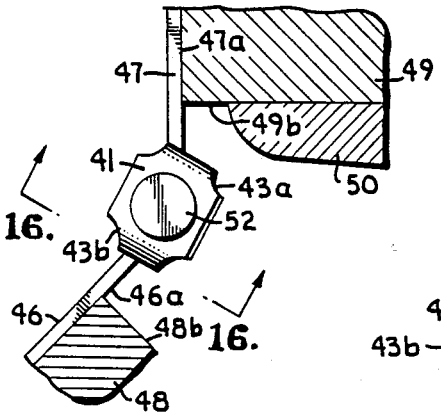
Fig.15.
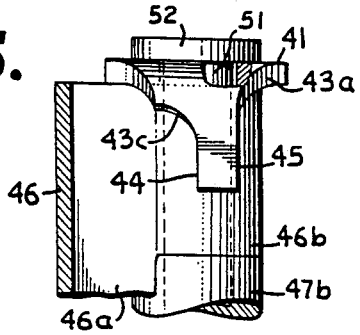
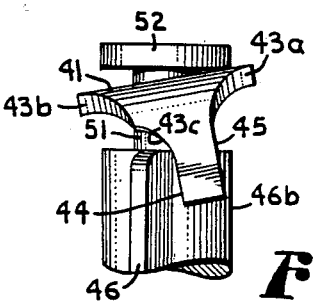
Fig.16.

HINGE MOUNTED DOORCHECK

BRIEF DESCRIPTION OF THE INVENTION

The subject device comprises a hinge mounted doorstop. A conventional hinge is employed, such having leaves adapted to engage the end of the door and a supporting wall surface or the like, as well as having interleaving hub members engageable by a hinge pin having an enlarged head.

The device itself comprises a channel member having a normally horizontal web with an opening formed through the web substantially centrally thereof. The web opening is sized to slideably receive a hinge pin shaft therethrough, but not the enlarged head thereof. The channel member also has two normally vertical flanges, each secured at the upper ends thereof to the web on opposite sides thereof. The flanges extend downwardly at least substantially parallel to one another.

In use, the channel member is adapted to rest on the web on top of the interleaved hinge hubs with the top hinge pin shaft extending through the web opening into said hub. The enlarged head or top of the hinge pin overlies the web in central portions thereof with the two flanges of the channel extending downwardly opposite from one another usually at least a substantial part of the length of the first topmost hinge leaf hub. The flanges are so positioned on the sides of the web that one edge of each flange will each respectively engage one face of each hinge leaf upon opening the door mounted by the hinge a certain arcuate distance, thus to act as a doorstop. The web is sufficiently wide and the flanges spaced far apart enough from one another so as to be able to each engage the hinge leaf faces without one of said flanges passing into the conventional gap in one of said hinge leaves at the topmost hinge hub.

A first form of the invention contemplates the flanges being symetrically mounted on the web with the edges of the flanges extending past the web opening for equal distances on each side thereof, thereby to act as a doorstop upon the hinge leaves opening some 90°. In the case of this option, the doorstop may be used equally effectively on either side of the flange edges so as to be effectively reversible.

A second form of the hinge mounted doorstop includes the flanges mounted toward one end of the web so that the engaging edges of the flanges are positioned substantially on the diametric line through the center of the web opening, thus to act as a doorstop upon the hinges separating from one another an arcuate amount of substantially 180°. With this form of the development, only one side of the flanges is operative to act as a doorstop.

In a third form of the invention, the flanges are so configured on each normally vertical side thereof, so as to provide substantially different door opening arcs on each side before engagement therewith with the hinge leaves. On one of the flange sides, the two opposed sides of the opposed flanges are substantially symmetrically mounted on the web with the edges of said flange sides extending past the web opening equal distances on each side thereof, thereby to act as a doorstop upon the hinge leaves opening approximately 90°. On the other hand, the other two opposite opposed sides of the flanges are configured so that at least end portions of the engaging edges of the flange are positioned substantially on a diametric line through the center of the web opening, thus to act as a doorstop upon the hinge leaves separating from one another an arcuate amount of substantially 180°. Thus this form of the invention is useable on both sides of the flanges, but only to provide substantially different arcuate openings for the door.

BACKGROUND OF THE INVENTION

The subject improvement basically relates to hinge mounted means for limiting the swinging movement of a door in relation to a wall or some other fixed member. Thus, the device relates to improvements adaptable to restrict the opening swing of the door with respect to the wall or member upon which the opposite side of the hinge is mounted.

Considerably attention and ingenuity has previously been devoted to the provision of devices for controlling the opening swing of doors or other hinge mounted members, largely for the purpose of preventing damage to adjacent walls or articles. A number of these prior devices, presently on the market, constitute fixed elements secured to the base board of a wall to serve as an abutment or stop to limit the swing of a door and thus prevent damage to a wall from the doorknob or another projecting element on the door. Such fixed member can be secured either to a wall or a door itself and such devices often include cushioning means of interlocking sockets and tongues to effect the same result. The principal disadvantages of these prior devices lie in the facts that they project into a room or space and may hinder movement of articles of furniture, as well as detract from the appearance of the room.

The present invention is directed to an improved hinge mounted device for effectivly limiting the swinging movement of a door, which device obviates all of the inherent disadvantages of the prior devices and yet performs it objectives effectively. This device is thus an improved door check for application to a conventional hinge operative to limit the swinging movement of the door. The subject door check has great simplicity of construction, ease of application to a conventional door hinge and inexpensiveness of production. The subject device can readily be applied to a conventional door hinge by the unskilled as well as the skilled.

THE PRIOR ART

Applicant is aware of the following U.S. patents directed to doorstops, door checks and hinged stops.

Hart U.S. Pat. No. 491,645, issued Feb. 14, 1893 for "Stop Hinge";

Isidor U.S. Pat. No. 609,277 "Trunk Hinge" issued Aug. 16, 1898;

Lickteig U.S. Pat. No. 2,143,275 "Hinge" issued Jan. 10, 1939;

Madsen U.S. Pat. No. 2,280,655 "Doorstop" issued Apr. 21, 1942; and

Allen U.S. Pat. No. 2,592,230 "Door Check" issued Apr. 8, 1952.

OBJECTS OF THE INVENTION

A first object of the invention is to provide an exceedingly simple, inexpensive, but sturdy form of hinge mounted doorstop that may be readily applied to a door by anyone without requiring the use of tools, nails, screws or like fastening devices and further without requiring a special form of hinge or any modification of the existing hinges.

Another object of the invention is to provide a doorstop device that can be mounted upon the door by removing the hinge pins from successive hinges and placing the device in question between the hinge pin head and the top of the hinge, preferably at such hinge.

Another object of the invention is to provide a hinge mounted doorstop device which eliminates the use of doorstops at the base board and those requiring changes in the hinge construction in order to adapt the same thereto.

Yet another object of the invention is to provide a doorstop comprising a channel with a normally horizontal, perforated web adapted to overlie the top of the hinge, there being two downwardly extending flanges on the sides of the web, one such flange for insertion between the fixed hinge leaf and the door trim and the other flange serving as a limiting stop for the hinge leaf on the door.

Still another object of the invention is to provide a doorstop construction of the character described wherein, by varying the position of the two downwardly extending flanges on the sides of the normally horizontal, perforated web, it is possible to vary the permitted degree to which the door may open, at least in the substantial range of 90° to 180°.

Another object of the invention is to provide a shaped channel with central web and side flanges, the central web operative to overlie the interleaved hinge hubs and be engaged by the hinge pin above the top said hub, the flanges being 180° opposed to one another and extending vertically downwardly on opposed sides or the top hinge hub substantially centrally thereof, whereby to engage the faces of the hinge leaves, upon opening the door, at approximately 90° to near 180°, depending on the flange positions on the web.

Still another object of the invention is to improve over the doorstop construction of Madsen U.S. Pat. No. 2,280,655 by providing a differently configured doorstop without the inherent structural weakness of the Madsen device.

Another object of the invention is to provide a single doorstop channel of the character described which has the capacity of affecting a near 90° doorstop on one side of the flanges of the channel while permitting a near 180° opening by use of the other side of the flanges of the channel.

Another object of the invention is to provide a doorstop which is entirely hinge mounted and which does not contact the door or any wall associated therewith, thus avoiding any damage thereof.

Yet another object of the invention is to provide a number of variously shaped channels with top webs perforated for the insertion of a hinge pin therethrough, depending flanges from the webs, the structure and relationship of each pair of the edges of the channel flanges determining the permissible degree of arcuate opening of a door.

Still another object of the invention is to provide extremely strong and rugged hinge mounted channels operable as doorstops to permit various degrees of door opening wherein the construction is so rugged that even forcible opening of the door will not bend the channel flanges or destroy the doorstop capability of the channel.

Other and further objects of the invention will appear in the course of the following description thereof.

THE DRAWINGS

In the drawings, which form a part of the instant specification and are to be read in conjunction therewith, embodiments of the invention are shown and, in the various views, like numerals are used to indicate like parts.

FIG. 10 is a top plan view of a formed flat piece of metal which will make up the channel of the subject invention after the side flanges are bent down.

FIG. 11 is a three-quarter perspective view from above of the formed piece of metal of FIG. 10 after the flanges have been bent or shaped into position to operate as a doorstop, the view taken from the side of the device which permits a near 180° opening as opposed to a near 90° opening as provided by the other side of the flange.

FIG. 12 is a top plan view of a door hinge with the device of FIG. 11 thereon with the door shut.

FIG. 13 is a top plan view of a door hinge, door and wall as in FIG. 12, the device of FIG. 11 being implaced on the hinge, the door having been opened to approximately 90° prior to actuation of the stop.

FIG. 14 is a view of the hinge, wall and door of FIGS. 12 and 13 with the door opened to the near 180° arc, typically 150° to 160°, with the stop having been actuated.

FIG. 15 is a view taken along the line 15—15 of FIG. 13 in the direction of the arrows.

FIG. 16 is a view taken along the line 16—16 of FIG. 14 in the direction of the arrows.

FIGS. 1-7, INCLUSIVE

Figure 1:
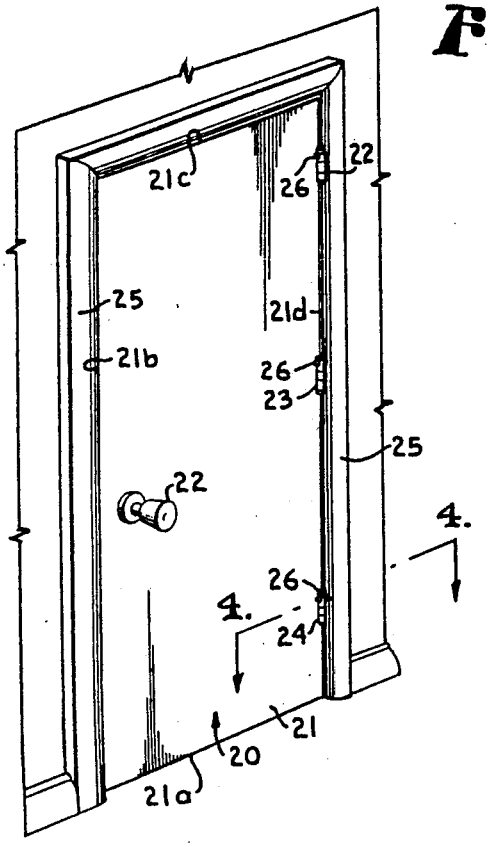
FIG. 1 is a three-quarter perspective view, from above, of a door which is closed in its frame and has one of the basic forms of the device for opening control mounted on each of the hinges thereof.

Referring to FIG. 1, therein is shown a door 20 which has an outer side 21, handle 22, bottom edge **21*a*, free side edge 21*b*, top edge 21*c* and hinge leaf carrying side edge 21*d*. The hubs of three hinges are seen at 22-24, inclusive. The door frame trim is seen at 25, surrounding the door on three sides thereof, specifically, the side edges and top edge. At the top of each hinge hub there is provided a device 26 of the structure seen in FIG. 2 with the head of the top hinge pin (FIGS. 3, 5 and 6) holding the devices 26**, one atop each set of hinge hubs as will be described.

Figure 2:
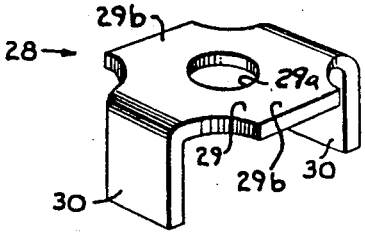
FIG. 2 is a three-quarter perspective view, from above, of the first form of the subject device operative to give a 90° opening control to a door.

Referring to FIG. 2, at 28 is generally designated a first form of hinge mounted door stop. Stop 28 has web 29 and downwardly turned flanges 30. Centrally of the web 29 there is provided opening 29*a*, while at 90° opposed to flanges 30 are web extensions 29*b*. Thus, doorstop 28 in FIG. 2 is actually a channel with a normally horizontal, perforated web portion 29 with two downwardly extending flanges 30 on the sides thereof. The web extensions 29*b* beyond flanges 30 on each side thereof are for the purpose of giving uniform strength and a uniform area of metal around the central perforation 29*a* and in the web. The device, as will be described and as may be seen in FIGS. 5 and 7, particularly, is a doorstop for a 90° hinge/door opening. In this structure the center of web hole or perforation 29*a* and the center of hinge pin top 27 are in line with the centers of the channel flanges 30. Flanges 30 extend parallel with one another. Said otherwise, in that both flanges 30 are parallel to one another, there is thus had, with web 29 therebetween, a channel construction.

Figure 4:
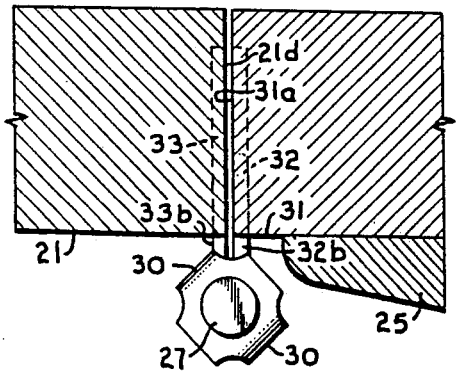
FIG. 4 is a view taken along the line 4—4 of FIG. 1 in the directin of the arrows.
Figure 5:
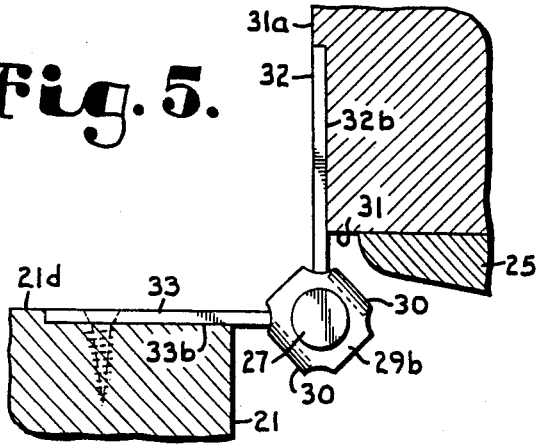
FIG. 5 is a view like that of FIG. 4, but with the door hinge opening 90° and "stopped" in its opening arc by the device of FIG. 2.
Figure 6:
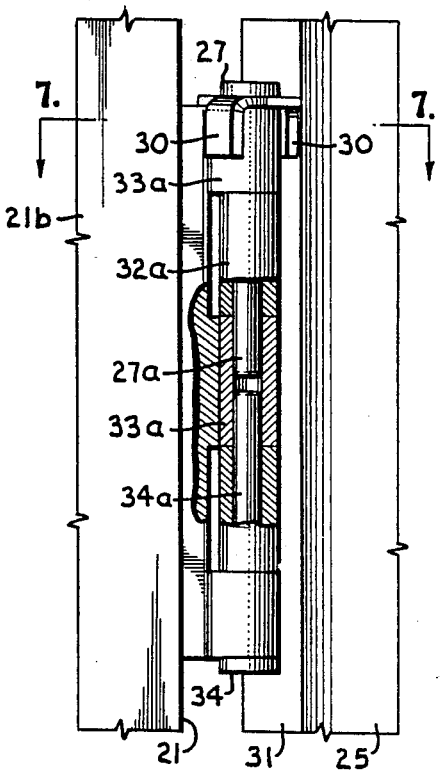
FIG. 6 is a frontal view of the door/jamb relationship of FIG. 5, with portions of the hinge construction cut away to show the hinge interior construction.

Referring now to FIGS. 3–7, inclusive, as well as FIG. 1, the wall upon which trim 25 is mounted is numbered 31. A first hinge leaf 32 is mounted on and fixed to the end 31*a* of wall 31. A second hinge leaf 33 is mounted on the hub members 32*a*, of hinge leaf 32 by its own hub members 33*a*. The top hinge pin shaft is seen in FIG. 6 at 27*a* and also therein is seen the head 34 and shaft 34*a* of the lower hinge pin, with both shafts 27*a* and 34*a* engaging the hinge pin hubs.

Figure 3:
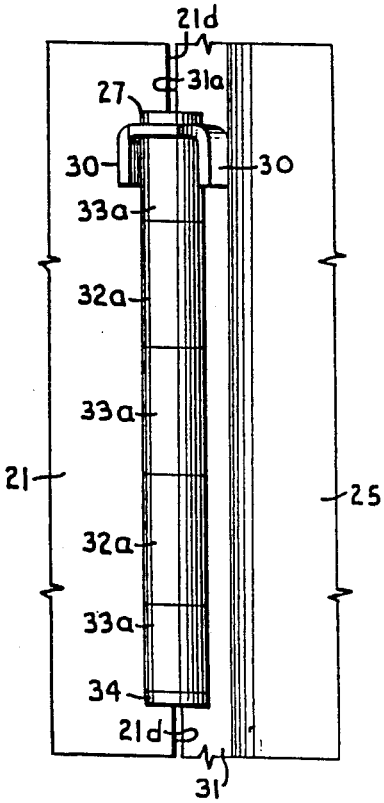
FIG. 3 is an enlarged frontal view of one of the hinges of FIG. 1 with the door in closed position showing a first from of the subject device mounted at the top of the hinge.

In FIGS. 1, 3 and 4, the door is shown closed with edge 21*d* of the door next to edge 31*a* of wall 31. In FIG. 4 the two hinge leaves 32 and 33 are seen almost abutting one another whereby the doorstop member 28 is free to move about somewhat on the hinge pin shaft 27*a* under head 27. There is no engagemnt of the flanges 30 by the hinge leaves 32 and 33. It is understood that each hinge on a door preferably has its own doorstop as seen in FIG. 1 or at least two out of the three hinges have the doorstop, but preferably all three, particularly the more massive door 20 is.

Figure 7:
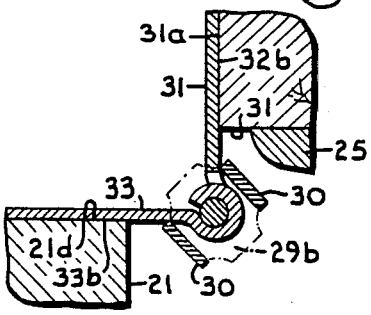
FIG. 7 is a view taken along the line 7—7 of FIG. 6 in the direction of the arrows (giving a view very much like that of FIG. 5, but showing how the legs of the device cooperate in stopping the hinge action).

In FIGS. 5–7, inclusive, the working of the doorstop 28 may be seen as the two hinge leaves 32, 33 are arcuately moved way from one another around the hinge leaf hubs 33*a* and 32*a*. What happens is that the faces 33*b* and 32*b* of hinge leaves 32 and 33, respectively, come into contact with edges of downwardly extending flanges 30 and are prevented or inhibited from further arcuate movement away from one another. Because the doorstop 28 is of relatively massive structure, the weight of the door does not bend or turn the opposed, parallel flanges 30 or their edges of abutment.

In the form of FIGS. 1–7, inclusive, the symmetry of the flanges on the center line or diametrical line through the hinge pin and hinge opening permits two way mounting. That is, the user cannot get the device on backwards. (This is not the case in the construction of FIGS. 8 and 9).

The projections 29*b* of web 29 are typically an artifact of manufacture. However, they give strength to the web 29. That is, when a flat rectangular piece is cut out adjacent the four corners thereof to form the flanges 30, the cutouts from the original rectangular metallic piece leave the projections 29*b* of the web. Then, when the flanges 30 are turned down, the web projections 29*b* extend past flanges 30 (as they did before flanges 30 were turned down).

The doorstop 28, when formed into the final shape of FIG. 2 comprises a channel with web 29 and flanges 30. Web 29 uniformly overlies the interleaved hinge hubs (in these figures over hub portion 33*a* at the top of FIG. 6, likewise for FIG. 3) being engaged by the hinge pin 27*a*, 27 above the top hub 33*a*. The flanges being 180° opposed to one another and extending vertically downwardly on opposed sides of the top hinge hub 33*a*, substantially centrally thereof, operate to engage the faces 33*b* and 32*b* of the hinge leaves upon opening the door 20 approximately 90°.

As may be seen in FIG. 7, flanges 30 are essentially bisected by the line through the center of the hinge pin and hinge hub opening. In the 90° opening limitation of FIGS. 1–7, inclusive, the edges of the hinge leaf contacting portions of the flanges 30 are approximately 32/1000 of an inch ahead of the hinge pin outer diameter. One wants the least sized device possible and least size flanges 30 to avoid running into trim 25. The device also must be wide enough between flanges 30 to catch the leaf 32 of the top leaf which is not directly connected to the top hub 33*a*, there being a clearance at the hub for that leaf.

FIGS. 8 AND 9

Figure 8:
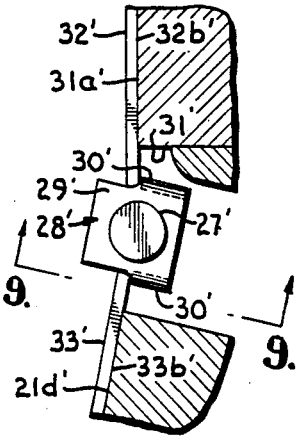
FIG. 8 is a view like that of FIG. 5 but showing an alternative form of the subject structure which permits an almost 180° opening to the door.
Figure 9:
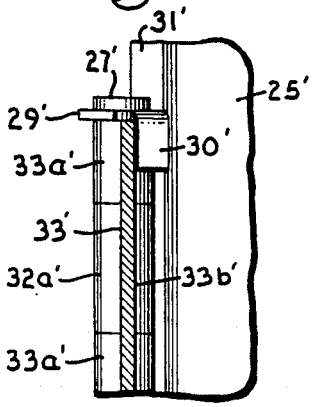
FIG. 9 is a view taken along the line 9—9 in FIG. 8 in the direction of the arrows.

Referring to FIGS. 8 and 9, therein is shown a doorstop very much like that seen in FIGS. 2, but designed so that the hinge leaves (and thus the door) may arcuately move apart almost 180°. The only distinctions in this device of FIGS. 8 and 9 as compared to the device of FIGS. 1–7, inclusive lie in the fact that the downwardly extending flanges of the channel are moved to one end of the web so that the hinge leaf contacting portions of the flanges are approximately in line with a diametric line through the hinge hubs and the hinge pin.

Because of the similarity in structure, all the parts of the doorstop device and the hinge, door and door frame elements are numbered the same, but primed. Accordingly, all the details of these structures will not again be redescribed.

In FIGS. 8 and 9, the two hinge leaves 32' and 33' are shown opening the hinges almost 180° and thus swinging door 21 almost 180° from its closed position which would be like FIG. 4 and FIG. 5 but 90° more. The web 29' of member or channel 28' overlies the top hinge hub 33*a'* and is received under the hinge pin 27'. It can be seen, when comparing FIG. 8 with FIGS. 7, hinge face 32*b'* is opposed almost 180° (typically 160°–170°) to hinge face 33*b'* without the limitation of the 90° stop made by the flanges 30' of the stop 28' in FIG. 7. To enable this opening, the hinge leaf contacting portions or edges of the flanges 30' are approximately (but not quite) in line with the center of the hinge pin 27', 27*a'*.

It should be evident that moving the flanges 30 (30') on the web 20 (29') from center to one end of the web has enabled the greater arc of door opening by the device of FIGS. 8 and 9. Intermediate distance movings of flanges 30' provide any degree of opening between the 90° opening of FIG. 7 and the near the 180° opening of FIGS. 8 and 9. As previously noted, the device of FIGS. 1–7, inclusive is symmetrical and thus cannot be applied in the wrong direction. This is not true of the device of FIGS. 8 and 9 and the flanges 30' must be positioned with respect to the hinge leaves 32' and 33' in the manner shown to get to the near 180° opening and stop.

The leaf contacting edges of this form of stop are typically positioned approximately 0.006 inches behind a diametric line through the center of the web opening.

FIGS. 10–16, INCLUSIVE

Referring to FIGS. 10–16, inclusive, therein is shown a doorstop of the character previously described which differs from the previously described stops in that one doorstop is able to provide two quite different degrees of openness or permitted openness of a door, depending upon which side of the flanges of the doorstop channel are positioned next to the hinge leaves. Thus, a substantially 90° arc door opening may be provided by one side of the channel flanges, while a near 180° opening (typically 150° to 170°) is provided by the other side of the channel flanges. This enables a user of the stop to select which degree of opening or how much arc of opening they wish to permit in the door for one stop.

Referring to FIG. 10, at 40 is generally designated a formed, shaped or stamped piece of metal, preferably steel, comprising the base piece for the channel of FIG. 11, the latter produced when the left and right hand wings or flanges 43 of the member 40 are formed or bent downwardly as seen in FIG. 11. Blank or channel 40 has web 41 centrally thereof with opening 42 therethrough operable to receive the shaft of the hinge pin (but not its enlarged head) as is seen in FIGS. 15 and 16. Web 41 has, formed integral therewith or attached thereto, flange portions 43. A first side of flanges 42 and 43, at **43*a* comprises an arcuate cutout with the shape of the cutout leading from an arcuate portion at web 41 to a straight line portion 45 thereof substantially the length or depth of flanges 43. The straight line of cutouts 43*a* is positioned tangent to or slightly away from a tangent taken to opening 42 parallel to the straight line portions of cutout 43*a*. The cutouts 43*a*** are to provide the substantially 90° opening option of the channel to be further described.

On the other side of blank or channel 40 there is seen a first cutout **43*b* which is preferably of the dimension and shaping of the arcuate portions of cutouts 43*a*. There is then provided second arcuate cutouts 43*c* which are approximately the same dimensions from the inner portion of cutouts 43*b* as cutouts 43*b* or 43*a*. Cutouts 43*c* outwardly end in straight portions 44 which are parallel to the straight portions 43 of cutouts 43*a*. A line extended from straight portions 44 centrally of openings 42** is either diametric or slightly less than diametric to provide the near 180° opening option.

The purpose of the configuration **43*b*, 43*c* is to provide, at the base of flanges 43 a wide area of attachment to web 41** for strength.

A comparison may be made between both sides of the flanges of the channel of FIG. 2 with the cutouts **43*a*. That is, the cutouts 43*a* are positioned substantially the same as the cutouts on each side of web 29 to provide the flanges 30. The straight line portions 45 of the blank of FIG. 10 are positioned substantially the same as the straight edges of flanges 30 with respect to opening 29*a***, thus to give the 90° or near 90° opening option.

On the other hand, the comparison of the other side of the blank with cutouts **43*b* and 43*c* is to be made both with respect to the channel of FIG. 2 and the channel of FIGS. 8 and 9. That is, the cutouts 43*b* are equivalent to the cutouts on the channel of FIG. 2 which resulted in flanges 30. The cutouts 43*c*, on the other hand, are equivalent to the cutouts with respect to the flanges 30' of the doorstop of FIGS. 8 and 9 with the straight portion of the cutouts (44 in FIG. 10) being essentially diametric with respect to opening 42** or near thereto.

Referring to FIGS. 12–14, inclusive, at 46 and 47 are shown the hinge leaves of a hinge of the structure seen in FIGS. 1–6, inclusive. Hinge faces **46*a* and 47*a* are attached, respectively, to a door 48 and a wall 49. Hinge 47 is typically in a recess 49*a* the end of wall 49 with one side of the wall seen at 49*b*. Trim 50 is attached to wall side or face 49*b***.

Hinge leaf 46 is typically received in a recess **48*a* in door 48, the outer side of 48 being indicated at 48*b***.

Referring to FIG. 15 and FIG. 16, portions of the hinge hubs of hinge leaves 46 and 47 are visible (in FIG. 15) as seen at **47*b*. The hinge hubs are joined together by the shafts 51 of the top hinge pin having head or cap 52** thereon.

In operation of the device of FIGS. 10–16, inclusive, first comes the forming or bending of flanges 43 at right angles to web 41 as seen in the finished channel of FIG. 11. This leaves one side of each flange 43 of a configuration substantially or exactly like one side of the web 29 and flange 30 of FIG. 2 (at **43*a* and 45), while portion 43*b* of the opposite side of flanges 43 is configured or formed in that manner also. The additional cutouts 43 provide walls 44 on said flange 43 side which are aligned as are the operative flange walls or sides of flanges 30' in FIG. 8 and 9**.

The device of FIG. 11 is shown in operation in FIGS. 12–16, inclusive only with respect to the near 180° opening side of flanges 43. The reason for this is that, when the device of FIG. 11 is oriented with the 90° opening sides **43*a*, 45 against bases 46*a* and 47*a* of hinge leaves 46 and 47, the operation of the device is exactly as has been described with respect to the device of FIG. 2 heretofore. On the other hand, when the device of FIG. 11 is oriented on the shaft 51 of the hinge pin, under top or cap 52, as is seen in FIGS. 12–16, inclusive with cutouts 43*b*, 43*c* and straight portion 44 oriented opposite hinge leaf faces 46*a* and 47*a***, the action is entirely different from anything heretofore described.

Thus, it can be seen from FIGS. 13 and 15 that, when the door and wall are at approximately 90° from one another, leaves 46 and 47 are still within the cutout portions **43*b*. However, as the door continues to open with respect to the wall, as seen in FIGS. 14 and 16, the hinge leaf faces 46*a* and 47*a* ride down into the cutout portions 43*c*, thence to abut against straight portions 44 of flanges 43. What this action causes is seen most graphically in FIG. 16, but also in FIG. 14 from the title of the web 41. As the hinge leaf faces 46*a* and 47*a* move down the curvature of cutout portions 43*c* from cutout portions 43*b*, since the straight portions 44 are essentially diametrically aligned with the center of the hinge pin and hinge pin hub openings, the web 41 (and attached flanges 43) tilt somewhat with the web rising away somewhat from the top of the hub portion 46*b*, thus camming up the hinge pin so that its top 52 is elevated and the uppermost portion of shaft 51 extends out of the hinge hub 46*b*, 47*b* portions. As the channel 40 tilts forwardly, away from hinge leaf faces 46*a* and 47*a*, the walls of the opening 42, as they are tilted as seen in FIG. 16 and FIG. 14, engage and jam against 180° opposed portions of hinge pin shaft 51 with the web 41 abutting the underside of cap or top 52**.

In FIG. 15, at the showing of the upper portion of shaft 51, there is seen a slight clearance between shaft 51 and opening 42. The fit of opening 42 with respect to shaft 51 is a sliding, not frictional fit which enables the tilting action of the channel as seen in FIGS. 14 and 16. This action does not begin until the faces 46a and 47a begin their travel down the cutout curvature 43c. At first, this merely cams, straight up, the hinge pin. Then, however, as the faces 46a and 47a reach or nearly reach the flat, straight portions 44, the web 41 begins to tilt outwardly or forwardly away from faces 46a and 47a into the locking or jammed position of FIG. 16. With the closing of the door, the hinge pin and channel 40 will typically fall back to the base portions seen in FIG. 15. It should be especially noted that the depth of the vertical portions of the cutouts 43b and 43c and straight portion 44 are less than one of the hinge hub elements (46b, 47b, etc.) so that the hinge pin is not taken out of engagement with any one of the hinge hub elements which initially it engaged. This closure is as strong and tight as the near 180° construction of FIG. 8 and FIG. 9. Again, it should be stated that the channel 40 is wide enough so that the engaging portions 43b, 43c and 44 will engage not only the hub 46b (FIGS. 15 and 16) but also the opposite portion of face 47a which is spaced away from or has clearance from the hub portion 46b, its first actual connection to the pin shaft 51 being at 47b in the lower right hand corner of FIG. 15.

Typical measurements, not limiting, for the channel of FIG. 11 involve a depth of flanges 43 from the top surface of web 41 to the bottom edge of flanges 43 of 0.38 inches. The dimension from the center of the orifice 42 to the outer face of turned down flanges 43, on each side, is typically 0.359 inches. The radius between the web 41 and flanges 43 on the underside is typically 0.062 inches.

Looking at FIG. 10, the opposed flat side of web 41 may be typically 0.624 inches. The width of the upper portion of flanges 43 taken from the straight line portions 44 upwardly may be typically 0.156 inches. The total width from left to right of the blank (FIG. 10) from flange end to flange end typically may be 1.250 inches. The device is symmetrical so from one edge of one flange to the center of opening 42 may be 0.625 inches. The width from the center of orifice 42 to the beginning of cutout portions 43 may typically be 0.187 inches.

Thus it is seen that, in addition to the single purpose channels of previous description, there can additionally be produced a single channel which has the power to effectively provide a near 90° opening and a near 180° opening with the same device.

It perhaps should be noted also that the device of FIGS. 10–16, inclusive, when once engaged with a hinge pin under the larger diameter top over opening 42, the hinge pin does not need to be fully removed to reverse opening degree choices. Specifically, that is, all the operator needs to do (looking at, first, FIG. 16) is to pull the top 52 enough further vertically that the ends of the 44 and 45 straight portions of flanges 43 can clear the leaf faces 46 and 47a and thus be spun around and dropped back into position. If one starts from the 180° opening of FIG. 16, the hinge leaves must be closed upon themselves to about a 90° setting to enable this reversal as the opening provided is only like that of FIGS. 5 and 7. Going vice versa, from the 90° stop angle utilizing cutouts 43a and straight portions 45, the hinge leaves 46 and 47 need not be moved to make the reversal (although the hinge pin 51, 52 will have to be lifted up again sufficiently to clear the straight portions 44 and 45). Once this reversal is accomplished, the action of FIGS. 13–16, inclusive will then be possible.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A hinge and a doorstop combination said hinge having hinge leaves adapted to engage the end of a door and a supporting wall surface as well as having interleaving hub members engaged by a hinge pin, said hinge pin having an enlarged head and a shaft, wherein said shaft is sized to fit into an opening through said interleaving hub members to pivotally connect said hub members and allow pivotal movement of the leaves about the hinge pin and wherein said enlarged head is large enough so that said head cannot fit through said opening and thus provides a stop for holding said hinge pin in said opening, said doorstop comprising a channel member having a normally horizontal web with an opening formed through said web substantially centrally thereof said web opening sized to slideably receive said hinge pin shaft therethrough but not the enlarged head thereof, said channel member also having two normally vertical flat flanges with each flange secured at the upper end of said flange to the web, further said flanges are secured to opposite ends of said web, and said flanges are parallel to each other, in said combination said web of said channel rests on top of said interleaved hinge hubs when said doorstop is in an operating position with the hinge pin shaft extending through said web opening into said hubs with the enlarged top of the hinge pin overlying said web in central portions thereof and said flanges extending downwardly on generally opposite sides of said hub and extend downwardly a sufficient distance such that said flanges can engage said leaves to prevent rotation thereof, further each vertically depending flange has a first vertical edge and a second vertical edge, wherein each respective edge is on opposite sides of its respective flange such that when the doorstop is set in a first operating position the hinge leaves will be free to travel in a range of from zero to substantially 90 degrees and at said substantially 90 degrees said hinge leaves will engage said first vertical edges of the flanges to prevent further opening of said hinge and when said doorstop is set in a second operating position that said hinge leaves will be free to travel in a range of from zero degrees to nearly 180 degrees and at said nearly 180 degrees said hinge leaves will engage said second vertical edges of the flanges to prevent further opening of said hinge, wherein to adjust the doorstop from one of said operating positions to the other of said operating positions requires moving said channel member together with said hinge pin upwardly away from said hub a sufficient distance such that the lowest portions of said flanges are entirely above the hinge leaves, rotating the channel 180 degrees, and then lowering said channel member and hinge pin until the web of said channel rests on top of the hub, such that said adjustment will cause opposite vertical edges of the flange to engage the hinge leaves to limit the amount of opening of said hinge.

* * * * *